United States Patent [19]

Defibaugh et al.

[11] Patent Number: 4,842,547

[45] Date of Patent: Jun. 27, 1989

[54] STAPLE CABLE STRAIN RELIEF

[75] Inventors: George R. Defibaugh, Mechanicsburg; William C. Ohl, Harrisburg, both of Pa.

[73] Assignee: AMP Incorporated, Harrisburg, Pa.

[21] Appl. No.: 196,642

[22] Filed: May 19, 1988

[51] Int. Cl.[4] ..... H01R 13/58

[52] U.S. Cl. ..... 439/460; 439/466

[58] Field of Search ..... 439/457, 459, 460, 465, 439/466; 248/56; 411/457–465

[56] References Cited

U.S. PATENT DOCUMENTS

| | | | |
|---|---|---|---|
| 3,424,856 | 1/1969 | Coldren | 174/153 |
| 4,021,604 | 5/1977 | Dola et al. | 174/51 |
| 4,130,329 | 12/1978 | Chandler et al. | 339/75 |
| 4,130,330 | 12/1978 | Chandler | 339/75 |
| 4,195,899 | 4/1980 | Radloff et al. | 339/103 |
| 4,422,705 | 12/1983 | Kasper | 339/103 |
| 4,516,822 | 5/1985 | Wolfel | 339/103 |
| 4,561,715 | 12/1985 | Sanchez | 339/103 |
| 4,728,237 | 3/1988 | Lorincz et al. | 411/457 X |

FOREIGN PATENT DOCUMENTS

| | | |
|---|---|---|
| 2233333 | 7/1971 | Fed. Rep. of Germany . |
| 2845402 | 10/1978 | Fed. Rep. of Germany . |
| 3229741 | 8/1982 | Fed. Rep. of Germany . |
| 2259462 | 1/1974 | France . |
| 2403664 | 9/1978 | France . |
| 1139373 | 6/1971 | Japan . |
| 769776 | 7/1974 | Japan . |
| 546350 | 4/1977 | Switzerland . |

OTHER PUBLICATIONS

AMP IS 3188, Rel 12/12/87.
EPO Standard Search Report.
EPO Standard Search Report Annex.

*Primary Examiner*—Eugene F. Desmond
*Attorney, Agent, or Firm*—David L. Smith

[57] ABSTRACT

An electrical connector (10) has a housing (12) containing multiple electric terminals (18). A multiple conductor cable (36) passes through an opening in the housing with each of the conductors terminated to the conductor terminating portion (19) of a respective one of the terminals (18). A strain relief region (20) is bounded by two sides (42,44) and a bottom abutment surface (32). Each of the sides has spaced mutually facing engagement surfaces (42,44). A U-shaped staple (30) has a bight (52) and two legs (54,56) extending therefrom to respective free ends (55,57). Each leg (54,56) is of an appropriate cross section, having large edges (62) and small edges (64), the small edges (64) include a plurality of barbs (66) spaced therealong in penetrating contact with the engagement surfaces (42,44). As the staple (30) is inserted into the connector housing (12) to a predetermined position, the cable (36) is compressed into the remaining space between the staple (30) and the abutment surface (32) such that the cable (36) is compressed a predetermined amount, thereby providing strain relief.

16 Claims, 4 Drawing Sheets

STAPLE CABLE STRAIN RELIEF

BACKGROUND OF THE INVENTION

The invention relates to strain relief and, in particular, to a staple strain relief which cooperates with a connector back shell to provide strain relief for a variety of cable sizes received in the back shell of an electrical connector.

When electrically terminating conductors or cables to an electrical connector, strain relief arrangements are known which minimize forces placed on the electrical terminations. The cable is secured to the housing to transfer thereto forces to which the cable is subjected.

As multiple conductor cables of smaller size are made, strain relief becomes more critical. Smaller electrical connections are more sensitive to strain forces, less space available for the leads decreases flexibility, and the multiplicity of conductors pose interference problems between the various conductors which further decreases flexibility. In such connectors, rigidity is desirable in the strain relief system.

Good strain relief of a cable terminated to a connector requires proper compression of the cable. Too much compression can reduce the cross-sectional area of conductor strands or in the extreme break conductor strands while too little compression of the cable permits undesirable movement of the cable within the strain relief structure. The clamping member receiving force from the cable should also be rigid for all directions of force applied by the cable.

Some prior art strain relief systems have used latching segments in serrated form which engage corresponding segments only at stepped locations. Those strain relief systems, which require movement of fingers in a direction perpendicular to the cable axis, lock into place only after excessive compression of the cable. An excessively compressed cable will not fully spring back even when the cable is not damaged by the overcompression. The full effect of the compression is therefore not achieved. Such strain relief systems are also susceptible to movement of the connector in a direction transverse to the latching teeth.

Various bolted strain relief systems have been used, but they are more time consuming to install. Bolted strain relief systems also typically have multiple parts that must be attached to a connector and also permit movement around the bolt holes.

SUMMARY OF THE INVENTION

An electrical connector has a housing containing multiple electric terminals. A multiple conductor cable passes through an opening in the housing with each of the conductors terminated to the conductor terminating portion of a respective one of the terminals. A strain relief region is bounded by two sides and a bottom abutment surface. Each of the sides has spaced mutually facing engagement surfaces. A U-shaped staple has a bight and two legs extending therefrom to respective free ends. Each leg is of an appropriate cross section, having large edges and small edges, the small edges include a plurality of barbs spaced therealong in penetrating contact with the engagement surfaces. As the staple is inserted into the connector housing to a predetermined position, the cable is compressed into the remaining space between the staple and the abutment surface such that the cable is compressed a predetermined amount, thereby providing strain relief.

In a preferred embodiment, the overall dimension between opposing barbs on the legs of the U-shaped staple increases from the free end of the legs toward the bight of the staple. Each barb thus plows through connector housing material not disturbed by a previous barb. Each staple leg is forced into the space between engagement surfaces with the relatively harder staple barbs digging into the relatively softer housing. Staples are inserted into a connector housing a predetermined distance to obtain a desired cable compression. The predetermined insertion distance is selectable in infinitely small increments. The barbs, designed for penetrating contact, achieve local deformation of the engagement surface. Some springback of the surface above the barbs is obtained because of the elasticity of the housing material. With a properly shaped barb, a substantial holding strength is achieved. There is also interference on the sides of the barbs where material is not displaced by the high local compressive force. This functions to restrain the legs of the staple against movement transverse thereto.

With the cable in place, the staple is pressed into the connector housing a predetermined distance to achieve the desired cable compression. The predetermined distance may not only be precisely selected for a particular cable, but a range of cable sizes may use the same connector housing size or staple size by modifying the insertion depth of the staple in a particular housing to compress the cable, in each case, a predetermined amount. As various tensile and bending forces are placed on the cable they are resisted by the compressed contact between the cable, the housing opposite the staple bight, and the staple, and are thus transferred to the connector housing.

Movement of the staple legs is resisted in all directions. The high penetrating force secures the staple in the connector housing so as to resists forces toward and away from barbs. The deformed housing material resists force that would tend to pull the staple out of the housing. The undisturbed material alongside each barb resists forces in the remaining direction. This rigid locking of the staple deters bending of the staple caused by forces placed on it by the cable, thereby maintaining secure contact between the cable and the connector housing, and maintaining the integrity of the strain relief.

In yet another preferred embodiment, the staple provides a ground path from a sheath on a shielded cable to the connector housing. The ground path is completed by folding the sheath back over the cable insulation with the sheath compressed between the insulation and the staple and housing.

DESCRIPTION OF THE PREFERRED EMBODIMENT

Figure 1:
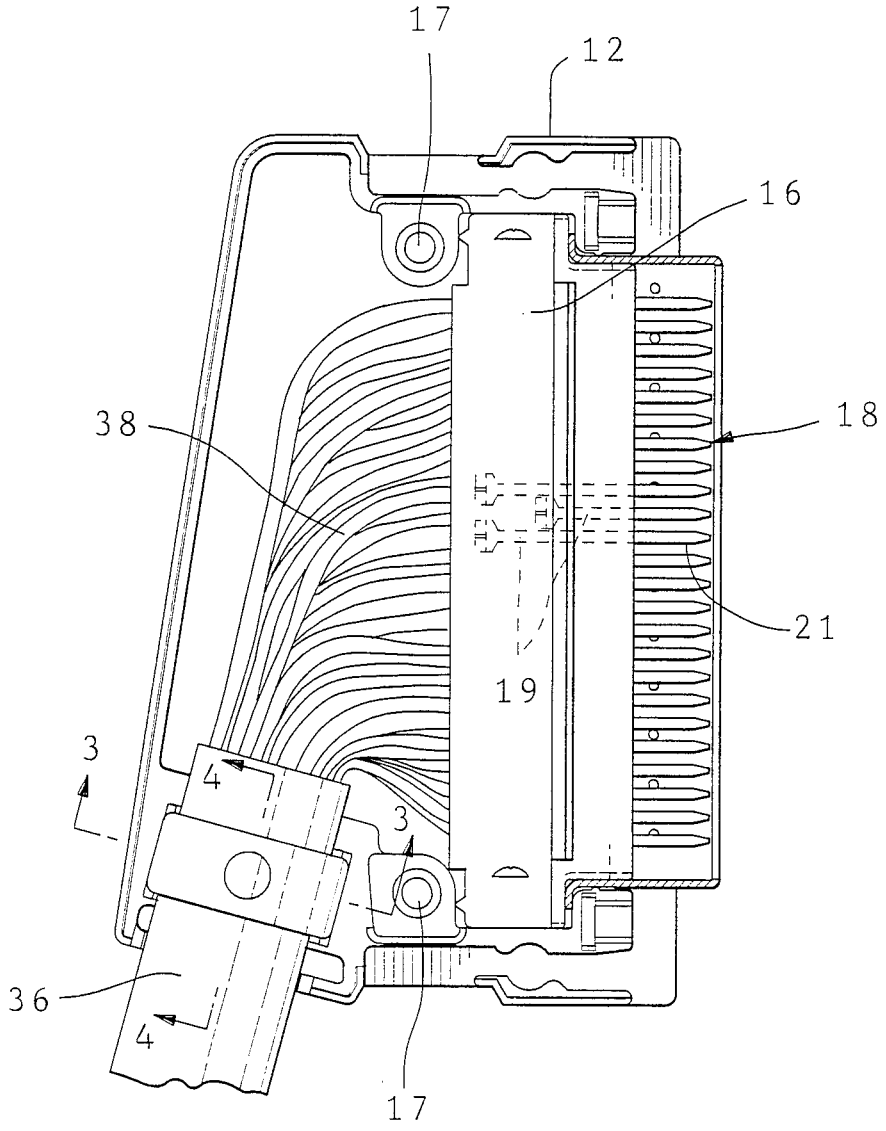
FIG. 1 is a top view of a connector, with the back shell cover plate removed, incorporating the staple strain relief of the present invention.
Figure 2:
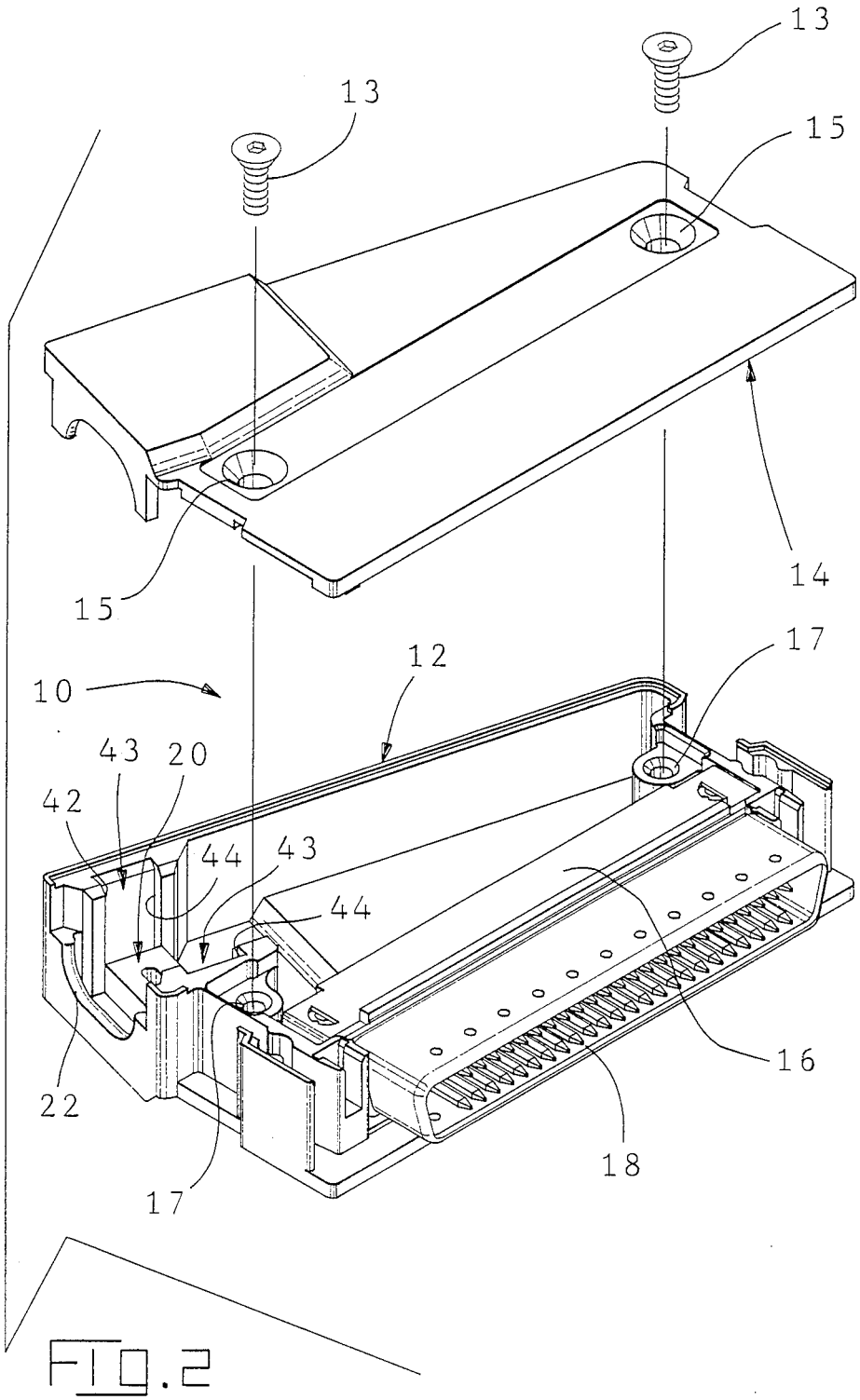
FIG. 2 is an exploded view of the connector without the cable and staple.

An electrical connector 10 includes a back shell or housing 12 and a back shell cover plate 14, both typically fabricated of an electrically conductive material such as die cast zinc. Back shell cover plate 14 is securable to housing 12 such as by screws 13 passing through apertures 15 and being threaded into recesses 17. Within back shell 12 is terminal spacer block 16 having a plurality of electric terminals 18 secured therein. Terminals 18 have a mating portion 21 and a conductor terminating portion 19. Conductors 38 are terminated to terminating portion 19 of terminals 18. A cable receiving opening 20 is located in the housing as part of the strain relief system hereinafter described. A somewhat circular opening 22 is located in back shell 12 spaced from opening 20 for cable 36 to pass through. A more detailed description of connector 10 and terminal spacer block 16 as well as the termination of conductors 38 to contacts 18 is found in copending applications Ser. Nos. 090,294 entitled Key Retention System and 090,296 entitled Cable Terminating Cover Retention System, both of which were filed Aug. 31, 1987, and both of which are hereby incorporated by reference.

Figure 3:
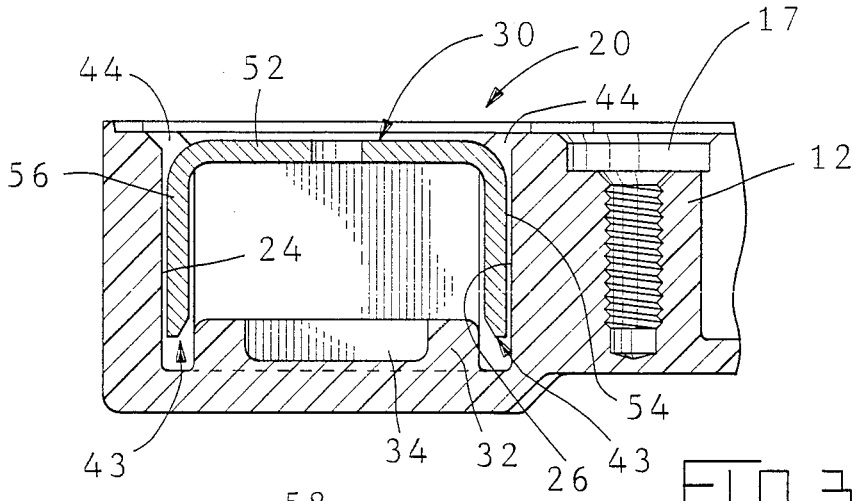
FIG. 3 is a sectional view through the cable restraint opening taken along the lines 3—3 in FIG. 1 with the cable removed for clarity.
Figure 4:
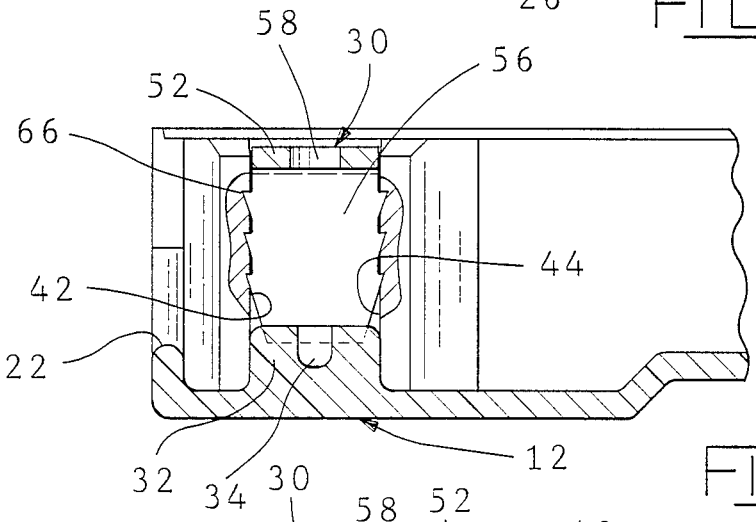
FIG. 4 is a partial sectional view taken along the lines showing the staple location.
Figure 5:
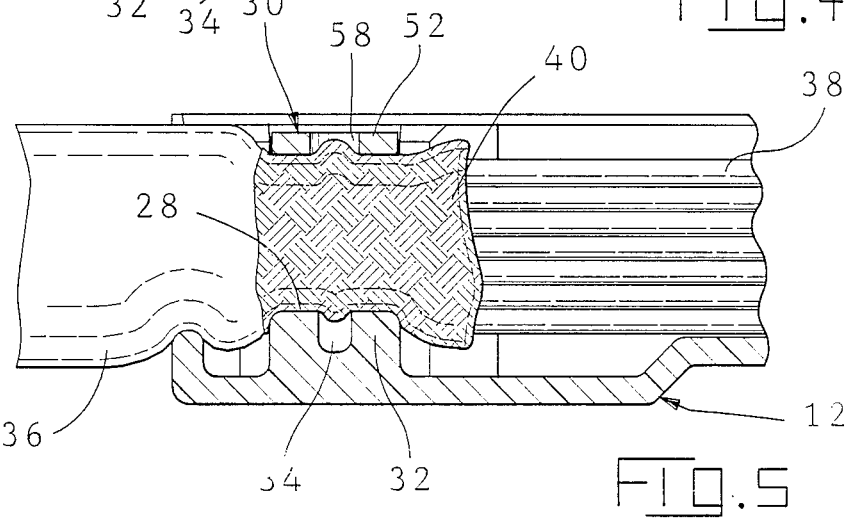
FIG. 5 is a partial sectional view similar to FIG. 4 showing the restrained cable.
Figure 6:
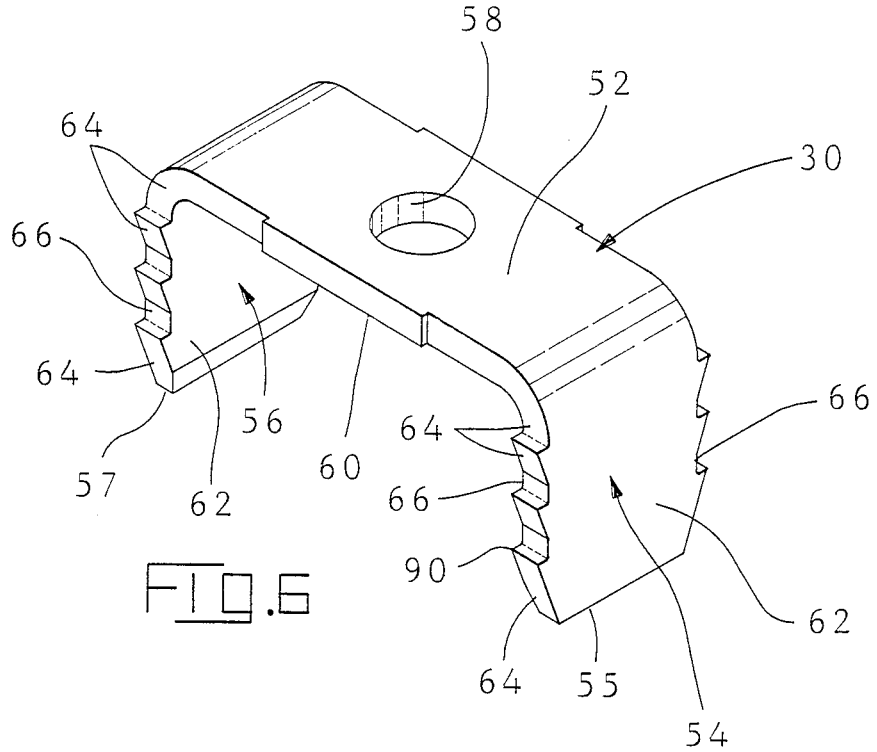
FIG. 6 is an isometric view of the staple.

The cable strain relief opening 20 as shown in more detail in FIGS. 3, 4 and 5 is bounded by two substantially parallel sides 24,26 and a bottom abutment surface 28. The fourth side is preferably left open to better receive staple 30 and when closed is comprised of bight 52 of staple 30.

A transverse boss 32 forms part of the bottom abutment surface and includes transverse recess or groove 34. This conventional boss enhances the holding or securing of multiconductor cable 36. Cable 36 contains the multiple insulated conductors 38 which are terminated to terminating portion 19 of terminals 18. Cable 36 may have a sheath in the form of braided shielding 40, which if present is folded back to contact staple 30 or back shell 12 completing an electrical path, typically ground, between braided shield 40 and staple 30 thence housing 12 or directly between braided shield 40 and housing 12. The electrical path is then continued from back shell 12 to the housing of a complementary connector left (not shown) to which connector 10 is mated.

Each of the parallel sides 24 and 28 has two mutually facing parallel engagement surfaces 42 and 44 defining therebetween a channel 43 in conjunction with a sidewall of housing 12. Channel 43 is sized to received a staple leg 54,56. Engagement surfaces 42, 44 and channel 43 therebetween preferably extend down beyond the top of boss 32. Surfaces 42 and 44 are each planular surfaces without any serrations therein. Staple 30 is sized to be forced into channel 43 to compress and secure cable 36 thereby providing strain relief thereto. Staple 30 has a bight 52 with two legs 54 and 56 extending therefrom to respective free ends 55,57. Recess or aperture 58 may be placed in the bight of staple 30 to improve the cable gripping capability. A widened portion 60 in the center of bight 52 compensates for material removed by the aperture and stiffens the center of the bight against bending.

Each leg 54,56 is rectangular in cross section having first and second major edges 62 as well as first and second minor edges 64. Barbs 66 are located on each minor edge. Each leg is monolithic so that there is great resistance to inward forces against the barbs. A taper extending rearward from the direction of insertion of staple 30, preferably 30°, facilitates entry of staple 30 into channel 43 without damage to cable 36.

Staple 30 is of a relatively hard material such as steel, and is typically electrically conductive. Barbs 66 engage and penetrate the engagement surfaces 42 and 44 which are of a relatively softer material. Thus, barbs 66 provide an interference fit with engagement surfaces 42,44 that secure staple 30 in channels 43 of housing 12.

Figure 7:
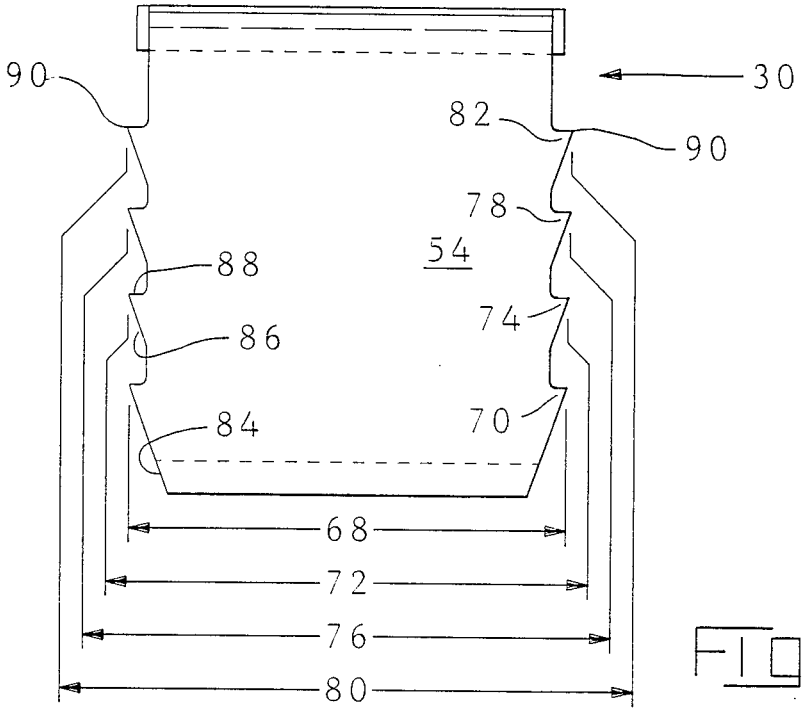
FIG. 7 is a detail end view of a staple showing the barbs.

Referring to FIG. 7, the tip-to-tip dimension 68 of lower barbs 70 nearest to the free end 55 of leg 54, or nearest to the free end 57 of leg 56, is slightly greater than the spacing between engagement surfaces 42 and 44. As staple 30 is pressed into channel 43 between surfaces 42 and 44, the engagement surfaces are locally deformed by the lower barbs 70 with some spring back. The tip-to-tip dimension 72 of barbs 74 is slightly greater than the dimension 68 such that barbs 74, upon insertion of staple 30, plow through housing material proximate engagement surfaces 42,44 that was undisturbed by barbs 70. The tip-to-tip dimension 76 of barbs 78 is slightly greater than dimension 72 such that barbs 76, upon insertion of staple 30, plow through housing material proximate engagement surfaces 42,44 that was undisturbed by barbs 74. The tip-to-tip dimension 80 of barbs 82 is slightly greater than dimension 76 such that barbs 82, upon insertion of staple 30, plow through housing material proximate engagement surfaces 42,44 that was undisturbed by barbs 78. Thus during insertion, any partial permanent deformation caused by a preceding set of barbs does not preclude engagement between a subsequent set of barbs and housing 12. Variations in tip-to-tip dimensions of barbs due to tolerances is also accounted for.

A lead-in taper 84, preferably 2020 from the longitudinal axis 83 of legs 54 and 56, facilitates entry of staple 30 into channel 43. A similar lead-in taper 86, preferably 20°, on the underside of each barb 66, facilitates insertion of staple 30. The upper surface 88 of each barb 66 is preferably normal to longitudinal axis 83. Tip 90 of each barb 66 preferably is sharp to maximize the local force concentration.

In use, cable 36 is placed in openings 20 and 22 preferably with braided shield 40 folded back over the outside of the insulation of multiconductor cable 36. Staple 30 is then inserted with legs 54 and 56 received in channels 43 and bight 52 transverse to the axis of cable 36 and spanning from one channel 43 to the other. Staple 30 is inserted into channels 43 to a predetermined position, compressing cable 36 to provide strain relief. The desired cable deformation, usually in the range of 20 to 25% volume reduction, is predetermined. In the compressed state, cable 36 substantially fills the remaining space between bight 52, legs 54,56 and boss 38. Cable 36 also bulges or protrudes around staple 30 and in the provided recesses 34,58.

The staple 30 travels linearly into position without movement axially along cable 36. Accordingly, all cable compression is retained. The final staple 30 position is predetermined to provide the desired strain relief, and may be at any point along the travel. As stated above, typical cable deformation is in the range of 20 to 25% volume reduction. Thus, a given staple size may be employed in a variety of housing sizes to provide strain relief to a variety of cable sizes.

The extremely rigid three dimensional strain relief of this staple strain relief system has been found to produce superior strain relief. When cable 36 is subjected to forces, the strain relief provided by staple 30 rigidly resists movement of the staple, as well as conductors between the staple and terminals 18, in a direction opposite to the direction of insertion of staple 30 in housing 12 due to barbs 66 biting into housing 12. The engaged barbs 66 provide an interference fit with housing 12 that rigidly resists forces tending to pull the staple out. Barbs 66 also provide electrical continuity between staple 30 and housing 12. When cable 36 is subjected to forces, the strain relief provided by staple 30 also rigidly resists movement of the staple normal to axis 83 and normal to the axis of cable 36. The resistance to movement is enhanced by barbs 66 being received in a minor groove in surfaces 42,46 formed by barbs 66 displacing housing material during insertion of staple 30. The rigidity of the strain relief tends to prevent bending of the cable from shifting and loosening the strain relief system.

We claim:

1. An electrical connector, comprising:

a housing having a plurality of contacts disposed therein;

a cable-receiving opening in said housing adapted to receive therein a multiple conductor cable, said cable-receiving opening having an axis, said opening bounded by two sides and a bottom abutment surface, each of said sides having two spaced mutually facing engagement surfaces defining a channel therebetween;

a U-shaped staple having a bight and two legs extending therefrom, said legs being of a cross-section having major edges and minor edges with barb means on each of said minor edges, said U-shaped staple adapted to be received in said cable-receiving opening with said legs received in said channels, said barb means adapted to engage said engagement surfaces in an interference fit, said staple adapted to compress a cable passing through said cable-receiving opening upon insertion of said staple legs into said channels with said bight of said staple spanning between said sides, the cable adapted to be compressed between said staple bight, said legs and said bottom abutment surface whereby strain relief is provided to the cable.

2. An electrical connector as recited in claim 1, wherein the barb means comprise at least two barbs on each minor edge, with a barb on a first minor edge of a leg associated with a barb on a second minor edge of the leg, the associated barbs defining a tip-to-tip barb dimension from the tip of one of said associated barbs to the tip of the other associated barb, said tip-to-tip barb dimension decreasing on associated barbs from the bight to the free end of said leg.

3. An electrical connector as recited in claim 1, wherein the barb means are a harder material than the engagement surfaces.

4. An electrical connector as recited in claim 1, wherein each of said legs is monolithic, whereby there is solid material between barb means on opposing minor edges of each leg.

5. An electrical connector as recited in claim 1, wherein the bight has a recess extending thereinto, whereby cable strain relief is enhanced.

6. An electrical connector as recited in claim 1, wherein the bottom abutment surface is a boss.

7. An electrical connector as recited in claim 6, wherein the boss has a recess therein to enhance strain relief.

8. An electrical connector, comprising:

a housing having a plurality of contacts disposed therein, a cable-receiving opening in said housing, said cable-receiving opening being bounded by two sides and a bottom abutment surface, each of said sides having two spaced mutually facing engagement surfaces defining a channel therebetween, a multiconductor cable received in said cable-receiving opening with each of said conductors terminated to a respective contact, a U-shaped staple having a bight and two legs extending therefrom, said legs being of a cross-section having major edges and minor edges with barb means on each of said minor edges, said U-shaped staple received in said cable-receiving opening with said legs received in said channels, said barb means engaging said engagement surfaces in an interference fit, said staple compressing said multiconductor cable passing through said cable-receiving opening, whereby strain relief is provided to the cable.

9. An electrical connector as recited in claim 8, wherein the barb means comprise at least two barbs on each minor edge, with a barb on a first minor edge of a leg associated with a barb on a second minor edge of the leg, the associated barbs defining a tip-to-tip barb dimension from the tip of one of said associated barbs to the tip of the other associated barb, said tip-to-tip barb dimension decreasing on associated barbs from the bight to the free end of said leg.

10. An electrical connector as recited in claim 8, wherein the barb means are a harder material than the engagement surfaces.

11. An electrical connector as recited in claim 8, wherein each of said legs is monolithic, whereby there is solid material between barb means on opposing minor edges of each leg.

12. An electrical connector as recited in claim 8, wherein the bight has a recess extending thereinto, whereby cable strain relief is enhanced.

13. An electrical connector as recited in claim 8, wherein the bottom abutment surface is a boss.

14. An electrical connector as recited in claim 13, wherein the boss has a recess therein to enhance strain relief.

15. An electrical connector as recited in claim 8 wherein the cable further comprises a shielding member, said shielding member passing through said cable receiving opening and received against said staple, thereby completing an electrical path from said shielding member to said staple, thence to said housing.

16. An electrical connector as recited in claim 8 wherein the cable further comprises a shielding member, said shielding member passing through said cable receiving opening and received against said housing, thereby completing an electrical path from said shielding member to said housing.

* * * * *